US005440911A

United States Patent [19]

Peglau et al.

[11] Patent Number: 5,440,911

[45] Date of Patent: Aug. 15, 1995

[54] PRE-REDUCTION EQUIPMENT AND METHOD

[75] Inventors: Manfred Peglau, Duisburg; Paul Koenen, Krefeld-Hüls, both of Germany

[73] Assignee: Mannesmann Aktiengesellschaft, Dusseldorf, Germany

[21] Appl. No.: 166,522

[22] Filed: Dec. 13, 1993

[30] Foreign Application Priority Data

Dec. 11, 1992 [DE] Germany ..... 42 42 423.2

[51] Int. Cl.[6] ..... B21B 19/00

[52] U.S. Cl. ..... 72/95

[58] Field of Search ..... 72/95, 96, 97

[56] References Cited

U.S. PATENT DOCUMENTS 5,125,251 6/1992 Pettersson et al. ..... 72/96

FOREIGN PATENT DOCUMENTS 309407 11/1993 Japan ..... 72/95

486820 10/1975 U.S.S.R. ..... 72/97

*Primary Examiner*—Lowell A. Larson

*Attorney, Agent, or Firm*—Cohen, Pontani, Lieberman, Pavane

[57] ABSTRACT

Pre-reduction equipment for guiding a pipe blank and reducing its end before it enters an "Assel" rolling mill, which is disposed immediately downstream from the pre-reduction equipment and consists of several freely rotatable rollers, which are disposed uniformly distributed about the pipe blank and can be set concentrically against the pipe blank and the setting motion of which can be controlled as a function of the determined position of the pipe blank. In order to make it reliably possible to initially roll particularly short pipe blanks with simple means, it is proposed that, for the initial rolling of short pipe blanks, the blanks are introduced into the "Assel" rolling mill by moving the pre-reduction equipment with the rollers clamping the pipe blank and, during the initial rolling in the "Assel" rolling mill, can be rotatably guided in lunette fashion by the rollers of the pre-reduction equipment.

5 Claims, 2 Drawing Sheets

PRE-REDUCTION EQUIPMENT AND METHOD

BACKGROUND OF THE INVENTION

1. Field of the Invention

The invention relates to pre-reduction equipment for guiding a pipe blank and reducing its end before it enters an "Assel" rolling mill, which is disposed immediately downstream from the pre-reduction equipment. The mill consists of several freely rotatable rollers, which are disposed uniformly distributed about the pipe blank and can be set concentrically against the pipe blank and the setting motion of which can be controlled as a function of a determined position of the pipe blank.

2. Description of the Related Art

Pre-reduction equipment of the generic type are known, for example, from the DE 38 23 135 C 2. They are used in order to avoid funnel-shaped triangular end parts of pipes rolled from pipe blanks in "Assel" rolling mills. Such triangular end parts arise in the process due to the fact that the end of the pipe, when rolled, expands. In the DE 38 23 135 C 2, in order to avoid these trumpet-shaped pipe ends, it is proposed that the diameter of the end part of the pipe blank be pre-reduced, before it runs into the reduction zone of the "Assel" rolling mill. As pre-reduction equipment, freely rotatable rollers are used, which, when viewed in the rolling direction, are disposed in a stand in front of the "Assel" rolling mill. The four rollers, distributed over the periphery of the pipe blank, can be adjusted concentrically with respect to the pipe blank. Shortly before the end part of the pipe blank enters this pre-reduction equipment, the rollers are switched on and the end part of the pipe blank is reduced in this way. In principle, this pre-reduction equipment has proven its value.

For the initial rolling of the pipe blanks in the "Assel" rolling mill it is necessary to push these blanks so far between the "Assel" rollers so that the latter take hold of the pipe blank. In this connection, it is known that the pipe blank can be clamped at its end so that it cannot rotate and be pushed with the front end into the rolling gap. It is a disadvantage that the pipe blank, so clamped, is twisted in the clamping device, if it is not released in good time. It is furthermore known that a contact shoulder can be provided at the mandrel rod, over which the pipe blank is pushed into the rolling gap. This has the disadvantage that the shoulder can be adjusted as a function of the length and must be geared to the dimensions of the pipe blank, which is to be subjected to an initial rolling process, that is, it must be exchangeable.

A special problem of the initial rolling of the pipe blanks arises when particularly short pipe blanks are used, because the feeding apparatuses have an inadequate lift for pushing the start of the pipe blank securely into the rollers of the "Assel" rolling mill. This is a problem particularly when the pipe blanks must be pushed in by means of the known pre-reduction equipment which, due to the method, must occupy a position at a certain distance from the "Assel" rolling mill.

SUMMARY OF THE INVENTION

It is an object of the present invention to improve an "Assel" rolling mill with pre-reduction equipment so that an initial rolling, particularly of short pipe blanks, with simple means is possible and reliable, without the disadvantages of the state of the art, which have been described above, such as the twisting of the pipe blank or the exchanging of the elements of the apparatus because of different dimensions.

Pursuant to this object, and others which will become apparent hereafter, one aspect of the present invention resides in, for the initial rolling of short pipe blanks, introducing the pipes into the "Assel" rolling mill by moving the pre-reduction equipment with the rollers that clamp the pipe blank. During the initial rolling in the "Assel" rolling mill, the rollers of the pre-reduction equipment are guided rotatably in a lunette-like fashion. In other words, the existing pre-reduction equipment is used for the purpose of pushing the short pipe blank between the "Assel" rollers for the initial rolling, in order then to take over the pipe blank-guidance like a lunette and finally to reduce the wall thickness at the end of the pipe blank in the known manner with the help of the concentrically closing rollers of the equipment in order to avoid triangulation. Aside from its actual purpose, the pre-reduction equipment is universally also used for the initial rolling of the pipe blank as well as for guiding to avoid twisting.

Provisions are made in an embodiment of the invention to use three rollers, which are disposed uniformly about the pipe blank and can be set against the pipe blank by means of piston-cylinder units, which act radially towards the center of the pipe blank. With such an arrangement and with appropriate synchronization of the piston-cylinder units, clamping can be carried out reliably and reducing of the end of the blank can also be accomplished.

Preferably, the rollers are mounted in a stand so as to be freely rotatable. Relative to the frame of the pre-reduction equipment, the stand can be moved in the longitudinal direction in slideways by means of piston-cylinder units, which are disposed parallel to the longitudinal axis of the pipe blank. Simple slideways on either side of the stand enable the stand to be guided securely by the required lift of about 200 mm.

Preferably, the stand is supported elastically in the frame, in order to be able to compensate for small deflections resulting from irregularities over the longitudinal direction of the pipe blank.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
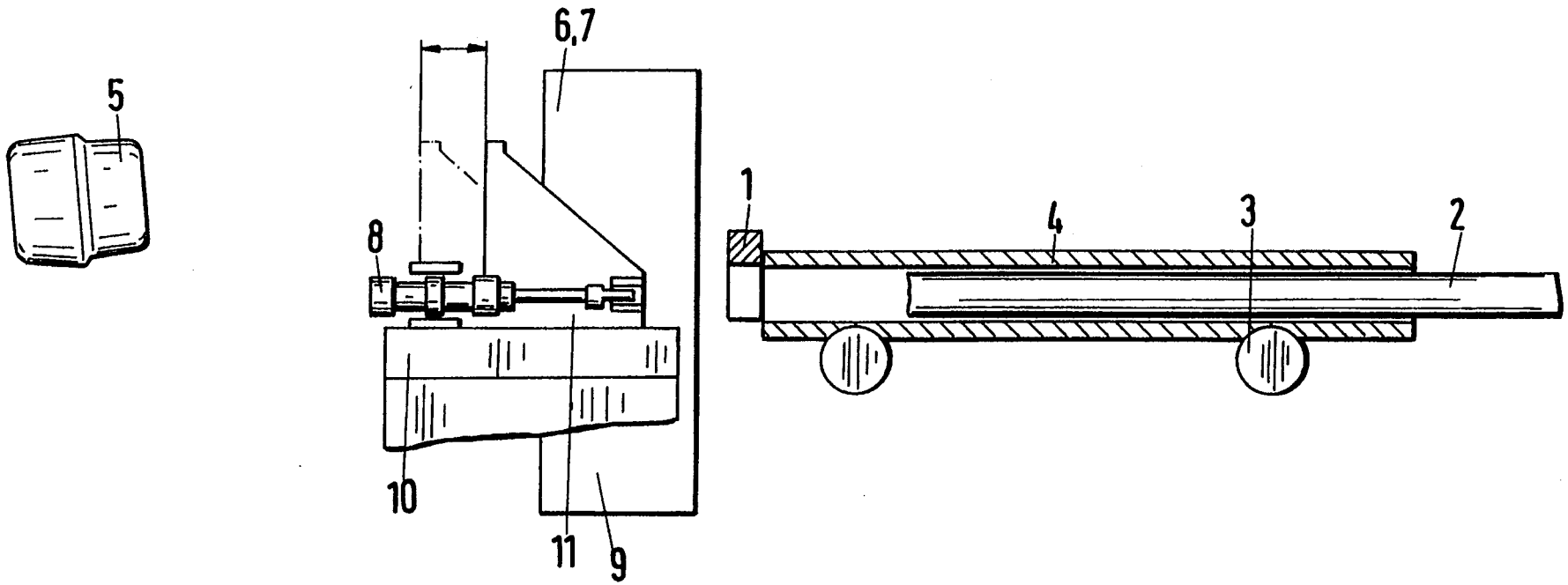
FIG. 1 shows a side view of the inventive pre-reduction equipment.
Figure 2:
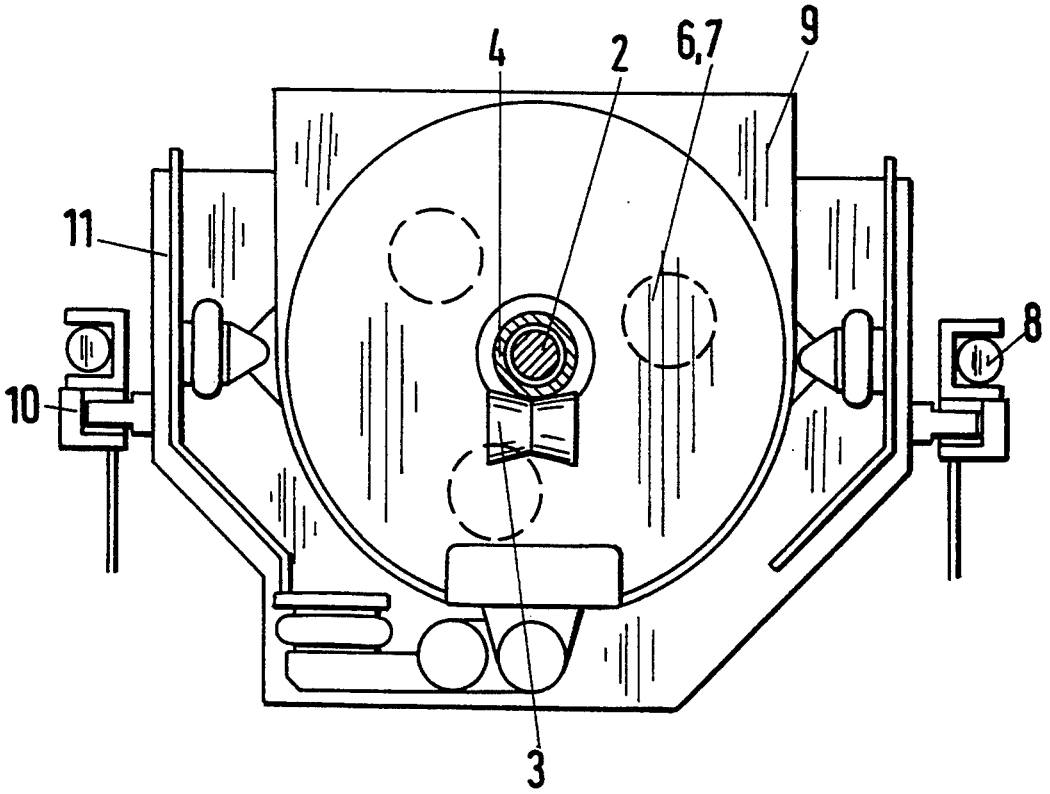
FIG. 2 shows a view in the longitudinal direction of the pipe blank.

As can be seen from FIG. 1, there is a short pipe blank 4 in front 1 of the leading edge of the stop 1. In this position, the dimension-dependent mandrel rod 2 is pushed in. The transporting roller table 3 then guides the unit, consisting of the pipe blank 4 and the mandrel rod 2, in the "Assel" rolling roll 5. If the pipe blank 4 is in the region of the "Assel" rollers, the rollers 7 of the pre-reduction equipment 6 move concentrically together and, activated by hydraulic cylinders controlled as a function of the path, clamp the external diameter of the pipe blank 4. After the pipe blank 4 is clamped, the two laterally disposed hydraulic piston-cylinder units, 8 move the whole pre-reduction equipment 6 together with the pipe blank 4 by a lift of about 200 mm in the direction of the "Assel" rolling mill 5 and, at the same time, push the pipe blank 4 between the rollers of the "Assel" rolling mill 5 for the initial rolling. During the initial rolling, the pipe blank 4 is caused to rotate. At the same time, the, pre-reduction equipment 6 rotates in the rollers 7, which therewith-in a lunette or semicircular supporting manner-take over the guidance of the blank (i.e. the rollers act as a backrest for the blank).

The rollers 7 are freely rotatable in a stand 9 that can be moved longitudinally relative to the frame 11 of the pre-reduction equipment 6. The stand 9 is movable in slideways 10 by means of the piston-cylinder units 8.

An infrared eye detects the blank end and controls the piston-cylinder units in a known manner as a function of the path for adjusting the rollers of the pre-reduction equipment 6 to a set value. With this, the pipe blank end is reduced to such an extent from a certain point in time onwards, that the triangulation of the pipe blank 4, described in the DE 38 23 135 C 2, and the therefrom resulting connector between the "Assel" rollers are prevented.

As soon as the pipe blank 4 is rolled out, the rollers 7 of the pre-reduction equipment 6 are opened and the lateral piston-cylinder units 8 move the pre-reduction equipment back into the starting position for a new working cycle.

If longer pipe blanks are rolled, for which the pre-reduction equipment 6 does not have to be shifted in the inventive manner, the pre-reduction equipment 6 can be used for its actual purpose, and as a lunette, that is, for guiding pipe blanks.

The invention is not limited by the embodiments described above which are presented as examples only but can be modified in various ways within the scope of protection defined by the appended patent claims.

We claim:

1. Pre-reduction equipment for guiding a pipe blank and reducing its end before the pipe enters an Assel rolling mill which is disposed immediately downstream of the pre-reduction equipment, comprising: a plurality of freely rotatable rollers uniformly distributed about the pipe blank so as to be adjustable concentrically with the pipe blank as a function of a determined position of the pipe blank; and means for introducing the pipe blank into the Assel rolling mill by moving the pre-reduction equipment with the rollers clamping the pipe blank so that an initial rolling of the pipe blank takes place before the blank enters the rolling mill, the rollers being provided so as to rotatably guide the pipe blank into the rolling mill in lunette-fashion during the initial rolling by the rollers.

2. The pre-reduction equipment of claim 1, wherein three rollers are uniformly distributed about the pipe blank, and further comprising piston-cylinder means for setting the rollers against the pipe blank, the piston-cylinder means acting radially towards the center of the pipe blank.

3. The pre-reduction equipment of claim 1, and further comprising: piston-cylinder means disposed parallel to the longitudinal axis of the pipe blank; a frame having slideways; and a roller stand provided so as to be longitudinally shiftable in the slideways relative to the frame, the rollers being mounted in the stand so as to be freely rotatable therein.

4. The pre-reduction equipment of claim 3, wherein the stand is elastically supported in the frame.

5. A method for guiding a pipe blank and reducing its end with pre-reduction equipment before the pipe enters an Assel rolling mill, comprising the steps of: uniformly distributing a plurality of rotatable rollers about the pipe blank, which rollers are adjustable concentrically with respect to the pipe blank as a function of a determined position of the pipe blank; introducing the pipe blank into the Assel rolling mill by moving the pre-reduction equipment with the rollers clamping the pipe blank so that an initial rolling of the pipe blank takes place prior to entering the rolling mill; and rotatably guiding the pipe blank with the rollers in a lunette-fashion during the initial rolling of the pipe blank by the rollers.

* * * * *